US012241465B2

(12) United States Patent
Pili et al.

(10) Patent No.: US 12,241,465 B2
(45) Date of Patent: Mar. 4, 2025

(54) PUMP AND FILLING ASSEMBLY

(71) Applicant: Enerpac Tool Group Corp., Menomonee Falls, WI (US)

(72) Inventors: Roger Roy Pili, Cambridge, WI (US); Michael Zimmer, Beaver Dam, WI (US)

(73) Assignee: Enerpac Tool Group Corp., Menomonee Falls, WI (US)

( * ) Notice: Subject to any disclaimer, the term of this patent is extended or adjusted under 35 U.S.C. 154(b) by 0 days.

(21) Appl. No.: 18/510,935

(22) Filed: Nov. 16, 2023

(65) Prior Publication Data

US 2024/0183350 A1 Jun. 6, 2024

Related U.S. Application Data

(60) Provisional application No. 63/386,260, filed on Dec. 6, 2022.

(51) Int. Cl.
*F04B 9/14* (2006.01)
*F04B 23/02* (2006.01)

(52) U.S. Cl.
CPC ..... *F04B 9/14* (2013.01); *F04B 23/025* (2013.01)

(58) Field of Classification Search
CPC .. F04B 9/14; F04B 33/00; F04B 53/06; F04B 53/18; F04B 53/16; F04B 23/02; F04B 23/025; B65D 1751/16; F01M 2011/0491
See application file for complete search history.

(56) References Cited

U.S. PATENT DOCUMENTS

| | | | | |
|---|---|---|---|---|
| 1,869,722 A | | 8/1932 | Thomas | |
| 1,996,792 A | | 4/1935 | Bystricky | |
| 2,116,760 A | | 5/1938 | Klein | |
| 2,311,078 A | | 2/1943 | Parker | |
| 3,316,853 A | | 5/1967 | Schneller | |
| 3,902,635 A | | 9/1975 | Jinotti | |
| 4,021,148 A | | 5/1977 | Moskowitz | |
| 4,044,913 A | * | 8/1977 | Brunnert | B60K 15/04 251/303 |
| 4,102,605 A | | 7/1978 | Moskowitz | |
| 5,000,335 A | * | 3/1991 | Osborne | B65D 88/76 220/745 |

(Continued)

FOREIGN PATENT DOCUMENTS

| | | | |
|---|---|---|---|
| CN | 201318202 Y | * | 9/2009 |
| EP | 0169662 A2 | * | 1/1986 |

(Continued)

*Primary Examiner* — Thomas Fink
(74) *Attorney, Agent, or Firm* — ANDRUS INTELLECTUAL PROPERTY LAW, LLP

(57) ABSTRACT

A pump and a filling assembly for a pump. The pump may generally include a flexible bladder configured to contain oil, the bladder having a bladder inlet and a bladder outlet; a pump mechanism in fluid communication with the bladder outlet and configured to dispense oil from a pump port; and a plug including a body extending along an axis and having a flange, a first stem extending from one side of the flange, and a second stem extending from an opposite side of the flange, the first stem being configured to extend into the bladder inlet, the body defining an oil passage and a separate air passage configured to allow simultaneous flow of oil into the bladder and air out of the bladder.

24 Claims, 8 Drawing Sheets

(56) References Cited

U.S. PATENT DOCUMENTS

| | | | | |
|---|---|---|---|---|
| 5,445,505 | A | 8/1995 | Hung | |
| 6,095,775 | A | 8/2000 | Divisi | |
| 6,722,855 | B2 | 4/2004 | Tien-Tsai | |
| 7,367,366 | B2 | 5/2008 | Liao | |
| 7,717,142 | B2 | 5/2010 | Padar | |
| 7,798,785 | B2 | 9/2010 | Tseng | |
| 8,651,339 | B2 | 2/2014 | Algueera Gallego | |
| 10,718,322 | B1 | 7/2020 | Rogish | |
| 10,895,252 | B2 | 1/2021 | Liao | |
| 2005/0084394 | A1 | 4/2005 | Mueller | |
| 2007/0048149 | A1 | 3/2007 | Chang | |
| 2012/0103465 | A1 | 5/2012 | Paluncic | |
| 2012/0138387 | A1 | 6/2012 | Torell | |
| 2020/0102941 | A1* | 4/2020 | Sun | F04B 9/14 |
| 2021/0172349 | A1 | 6/2021 | Chen | |

FOREIGN PATENT DOCUMENTS

| | | | |
|---|---|---|---|
| EP | 0855549 | A1 | 7/1998 |
| EP | 1717159 | A2 | 11/2006 |
| EP | 2447485 | A1 | 5/2012 |
| WO | 2009027374 | A1 | 3/2009 |
| WO | 2012130556 | A2 | 10/2012 |

* cited by examiner

PUMP AND FILLING ASSEMBLY

CROSS REFERENCE TO RELATED APPLICATION

This application claims benefit of priority to U.S. Provisional Application No. 63/386,260, filed Dec. 6, 2022, which application is hereby incorporated by reference in its entirety.

FIELD

The disclosure generally relates to pumps and, more specifically, to a filling assembly for a hydraulic pump.

SUMMARY

In one independent aspect, a pump may generally include a flexible bladder configured to contain oil, the bladder having a bladder inlet and a bladder outlet; a pump mechanism in fluid communication with the bladder outlet and configured to dispense oil from a pump port; and a plug including a body extending along an axis and having a flange, a first stem extending from one side of the flange, and a second stem extending from an opposite side of the flange, the first stem being configured to extend into the bladder inlet, the body defining an oil passage and a separate air passage configured to allow simultaneous flow of oil into the bladder and air out of the bladder.

In another independent aspect, a pump may generally include a cylinder having a cylinder wall with a first cylinder end and an opposite second cylinder end; a flexible bladder supported by the cylinder and configured to contain oil, the bladder having a bladder outlet positioned proximate the first cylinder end and a bladder inlet positioned proximate the second cylinder end; a pump mechanism engaging the first cylinder end, the pump mechanism being in fluid communication with the bladder outlet, the pump mechanism including a manual actuator engageable by an operator to cause the pump mechanism to dispense oil from a pump port; and an oil filling assembly positioned proximate the second cylinder end. The assembly may generally include a plug including a body defining an oil passage and a separate air passage configured to allow simultaneous flow of oil into the bladder and air out of the bladder, the body extending along an axis and having a flange, a first stem extending from one side of the flange, and a second stem extending from an opposite side of the flange, the first stem being configured to extend into the bladder inlet, the second stem having a stem end surface defining an air outlet communicating with the air passage, and an end cap engaging the second cylinder end, the end cap providing a funnel having a funnel wall surrounding the plug, oil in the funnel flowing to the oil passage, the end cap having a cap end surface, the stem end surface being axially beyond the cap end surface and outside of the funnel wall.

In yet another independent aspect, a filling assembly for a pump may be provided. The pump may include a flexible bladder configured to contain oil, the bladder having a bladder inlet and a bladder outlet, and a pump mechanism in fluid communication with the bladder outlet and configured to dispense oil from a pump port. The assembly may generally include a plug having a body extending along an axis, the body including flange, a first stem extending from one side of the flange, and a second stem extending from an opposite side of the flange, the first stem being configured to extend into the bladder inlet, the body defining an oil passage and a separate air passage configured to allow simultaneous flow of oil into the bladder and air out of the bladder.

Independent features and independent advantages may become apparent to those skilled in the art upon review of the detailed description, drawings and claims.

DETAILED DESCRIPTION

Before any independent embodiments are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Relative terminology, such as, for example, "about", "approximately", "substantially", etc., used in connection with a quantity or condition would be understood by those of ordinary skill to be inclusive of the stated value and has the meaning dictated by the context (for example, the term includes at least the degree of error associated with the measurement of, tolerances (e.g., manufacturing, assembly, use, etc.) associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%. 10% or more) of an indicated value.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

The embodiment(s) described below and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

Figure 1:
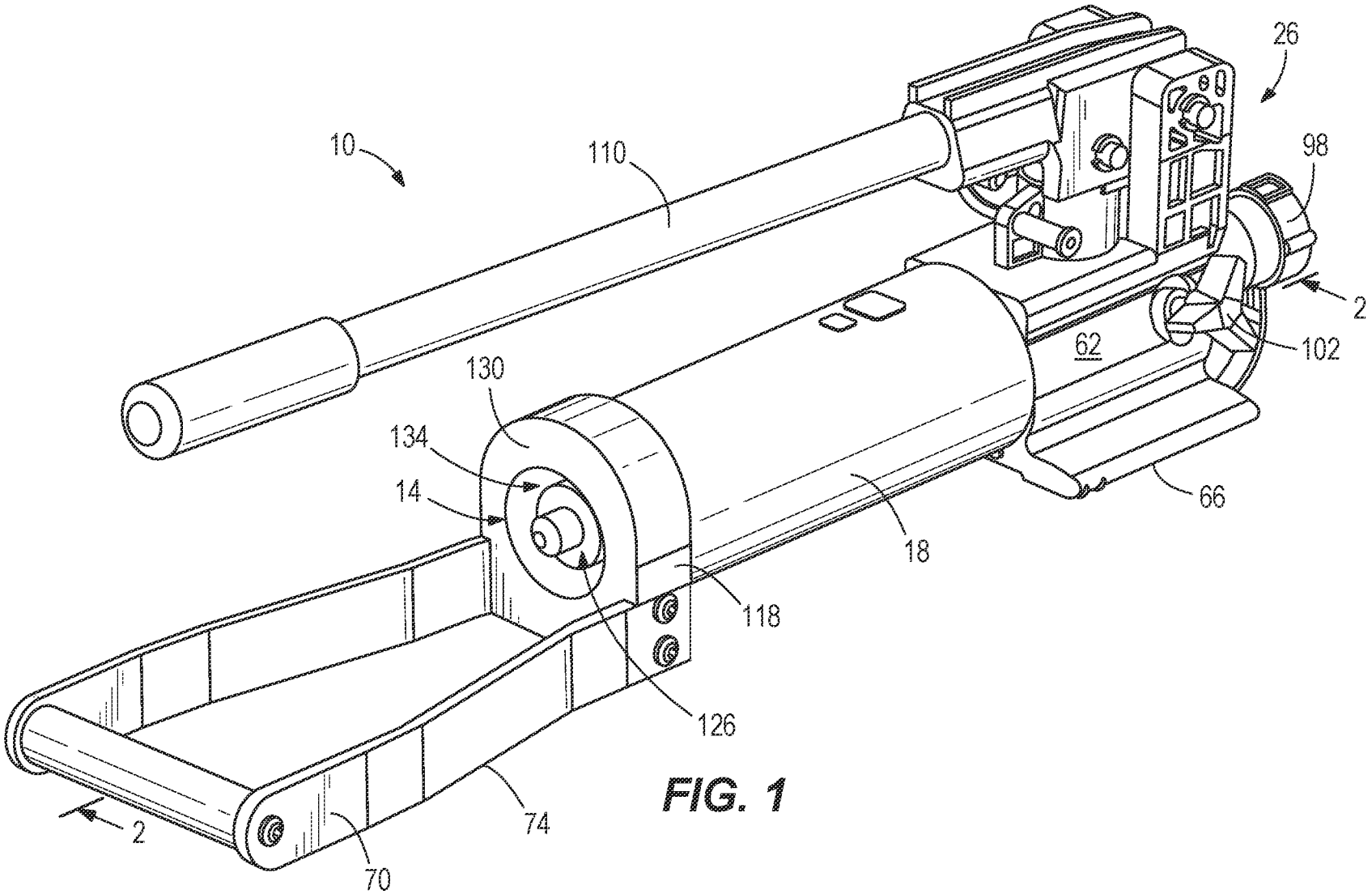
FIG. 1 is a perspective view of a pump.
Figure 2:
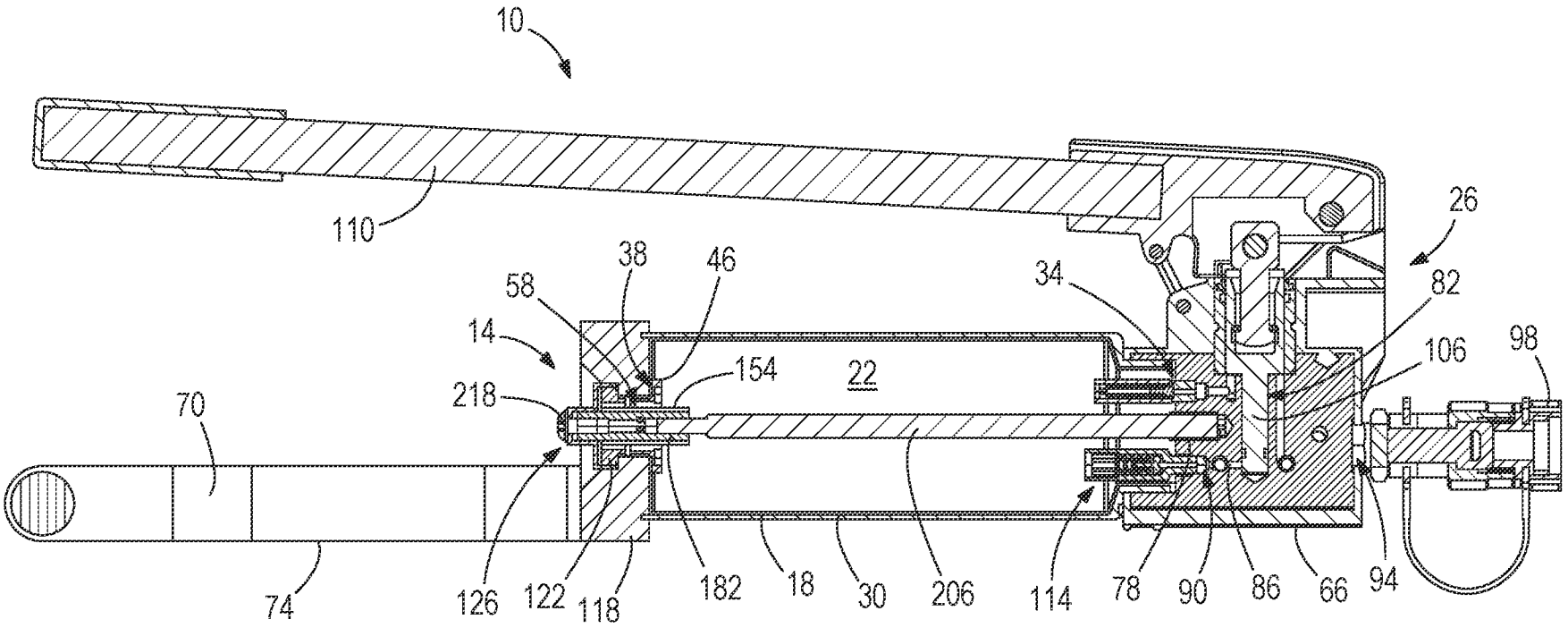
FIG. 2 is a side cross-sectional view of the pump shown in FIG. 1.

FIGS. 1-2 illustrate a pump 10, such as a hydraulic pump, operable to transfer fluid relative to an external device (e.g., a hydraulic cylinder (not shown)). Features of the pump 10 may be similar to features of the HP-series hand pumps (Model Nos. HP350, HP550, etc.) sold by Enerpac Tool Group Corp., Menomonee Falls, Wisconsin, USA, which are hereby incorporated by reference. The illustrated pump 10 also includes an oil filling assembly 14. In other constructions (not shown), the pump 10 may be operable to transfer other fluids. In the illustrated construction, the pump 10 is manually-operated (e.g., a hand pump). In other constructions (not shown), the pump 10 may be powered (e.g., by a motor).

The pump 10 also includes (see FIG. 2) a rigid cylinder 18 supporting a bladder 22 for holding oil and a pump mechanism 26 connected to one end of the cylinder 18 and operable to pump oil relative to the bladder 22. In the illustrated construction, the oil filling assembly 14 is connected to the opposite end of the cylinder 18 and is operable to fill the bladder 22 with oil.

The bladder 22 has (see FIGS. 2-3B and 8) a flexible wall 30 defining an interior volume, a bladder outlet 34 communicating with the pump mechanism 26, and a bladder inlet 38 defined through an end wall 42 and communicating with oil filling assembly 14. With the sealed bladder 22, the pump 10 is operable in substantially any orientation.

A bladder fitting 46 is positioned in the bladder 22 and, as illustrated, is operable to connect and seal the bladder 22 and the oil filling assembly 14. The fitting 46 has a flange 50 positioned against the inner surface of the inlet end wall 42 and an externally-threaded stem 54 extending through the inlet 38. A fitting opening 58 extends through the fitting 46 and into the bladder 22.

The pump mechanism 26 includes a pump housing 62. Externally (see FIG. 1), the illustrated pump housing 62 provides a support 66 to support the pump 10 on a surface (e.g., the ground). A carrying handle 70 (e.g., a shovel handle) provides a support 74 spaced along the axis of the pump 10 and generally aligned with the housing support 66.

Internally (see FIG. 2), the pump housing 62 cooperates with the cylinder 18 to capture the outlet end of the bladder 22. The pump housing 62 defines a threaded opening 78. The pump housing 62 also defines a chamber 82 and passages 86 communicating with the chamber 82 from a pump mechanism inlet 90, communicating with the bladder 22, to a pump mechanism outlet 94, communicating with a pump port or outlet 98.

Figure 9:
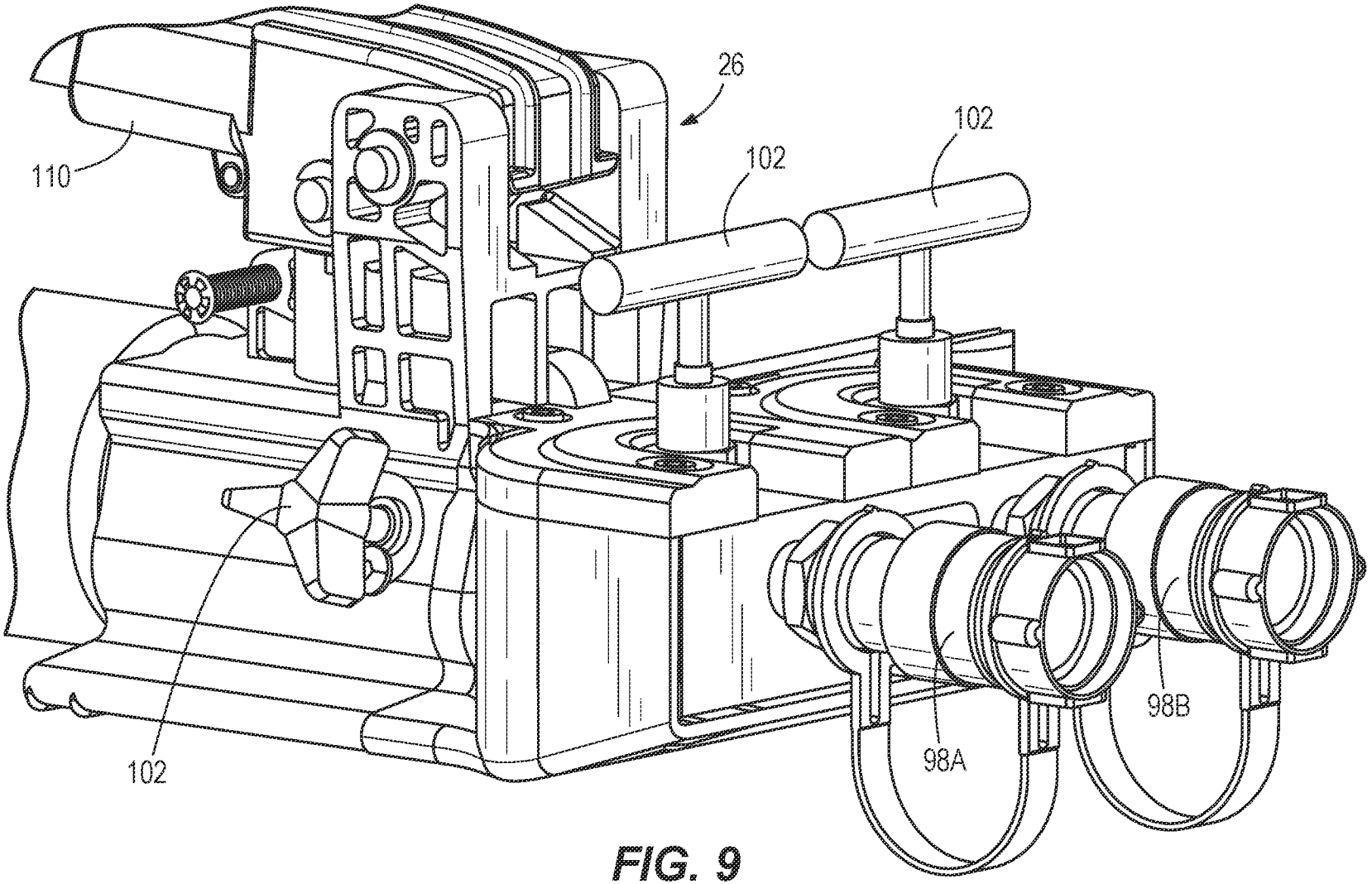
FIG. 9 is a perspective view of the pump shown in FIG. 1, illustrating an alternative construction of pump output ports.

As shown in FIGS. 1-2 and 9, the pump 10 includes a single pump outlet 98. In other constructions (see FIG. 10), the pump 10 includes more than one pump outlet 98A, 98B (a dual outlet, shown). A control valve assembly 102 (see FIGS. 1 and 10) is operable to control flow (e.g., direction, other flow characteristics, etc.) relative to the pump 10 and the outlet(s) 98, 98A, 98B. The valve assembly 102 is between the pump mechanism outlet 94 and the pump outlet(s) 98, 98A, 98B. The pump 10 may include one or more sensors, gauges, etc. (e.g., a pressure gauge (not shown)) to communicate an operating pressure to an operator.

A piston 106 is movably supported in the chamber 82, and an actuator (e.g., a handle 110, as shown) is operable to move the piston 106 in the chamber 82 and to cause oil flow relative to the bladder 22. A check valve assembly 114 is supported by the pump housing 62 to control flow into and out of the chamber 82 during movement of the piston 106.

Figure 3B:
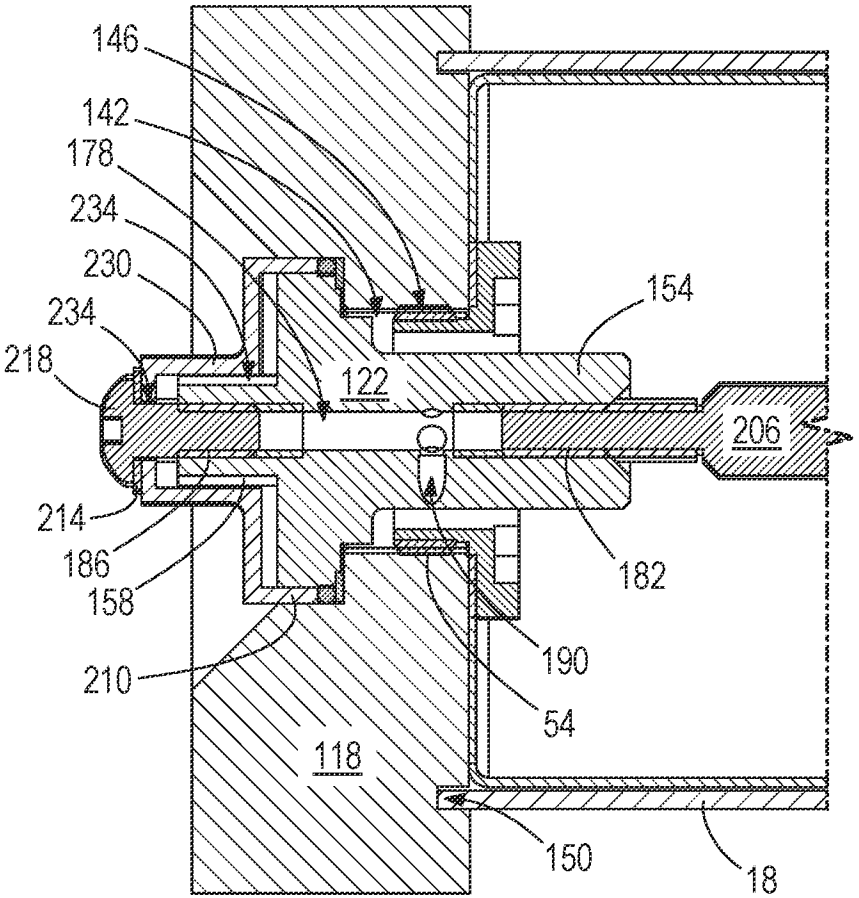
FIGS. 3A-3C are enlarged side cross-sectional views of a portion of the pump shown in FIG. 1, illustrating the oil filling assembly.
Figure 3A:
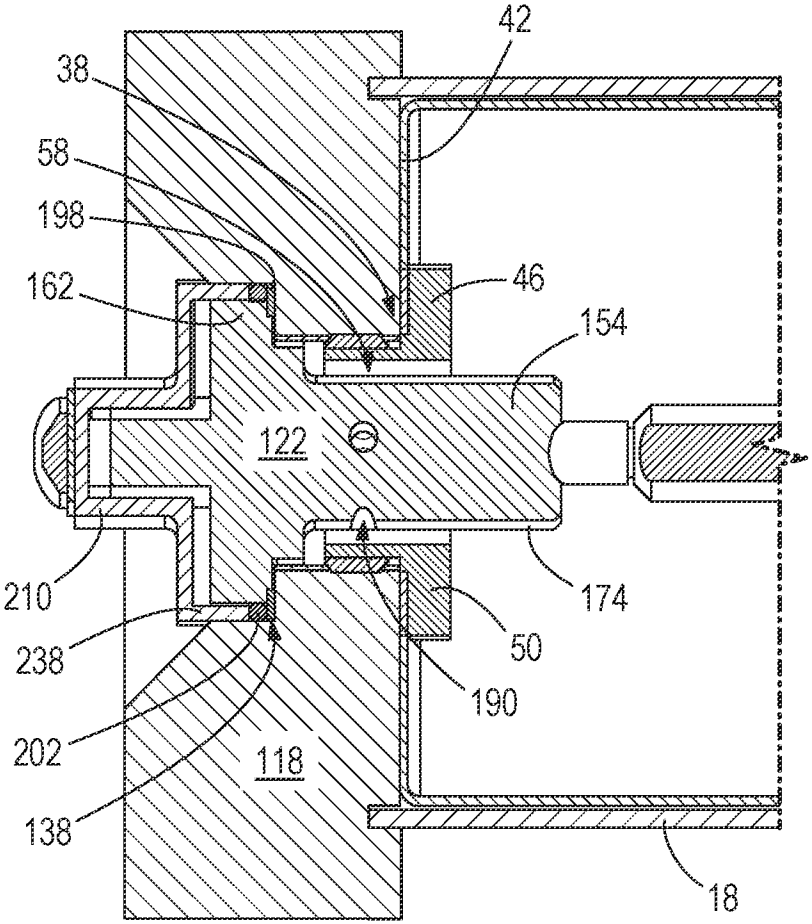
Figure 3C:
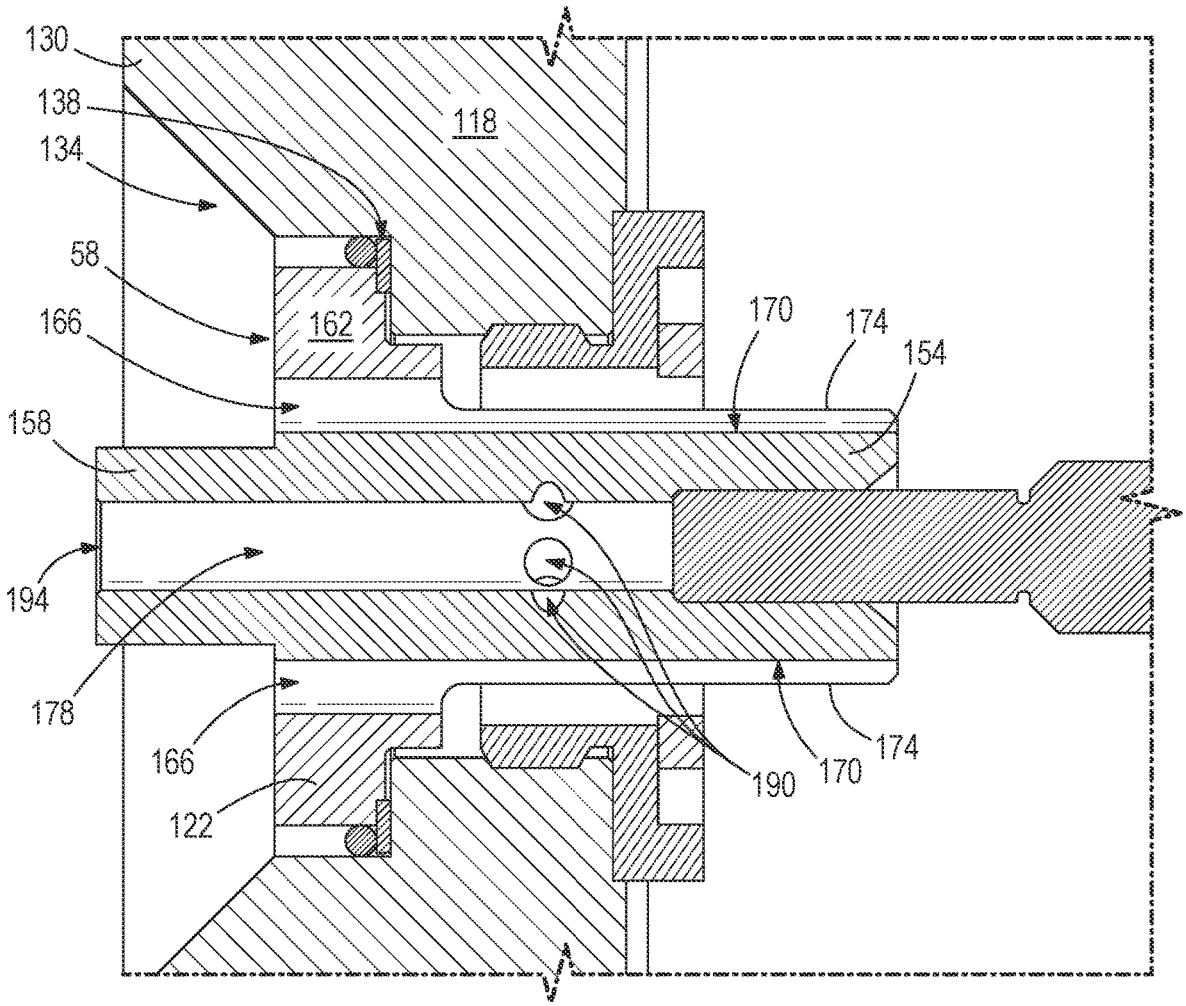
Figure 4:
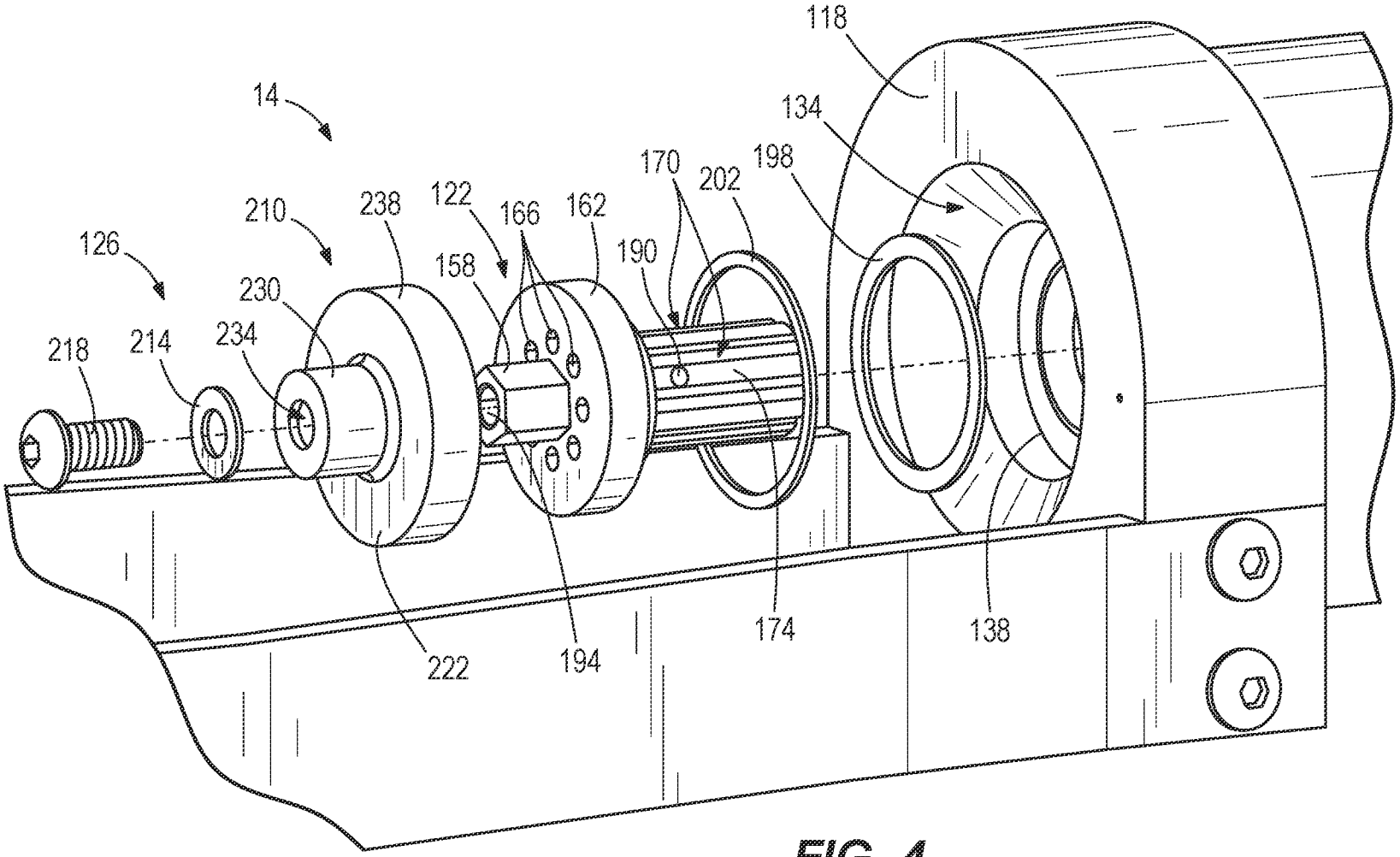
FIG. 4 is a perspective exploded view of a portion of the pump shown in FIG. 1, illustrating an oil filing assembly.
Figure 5:
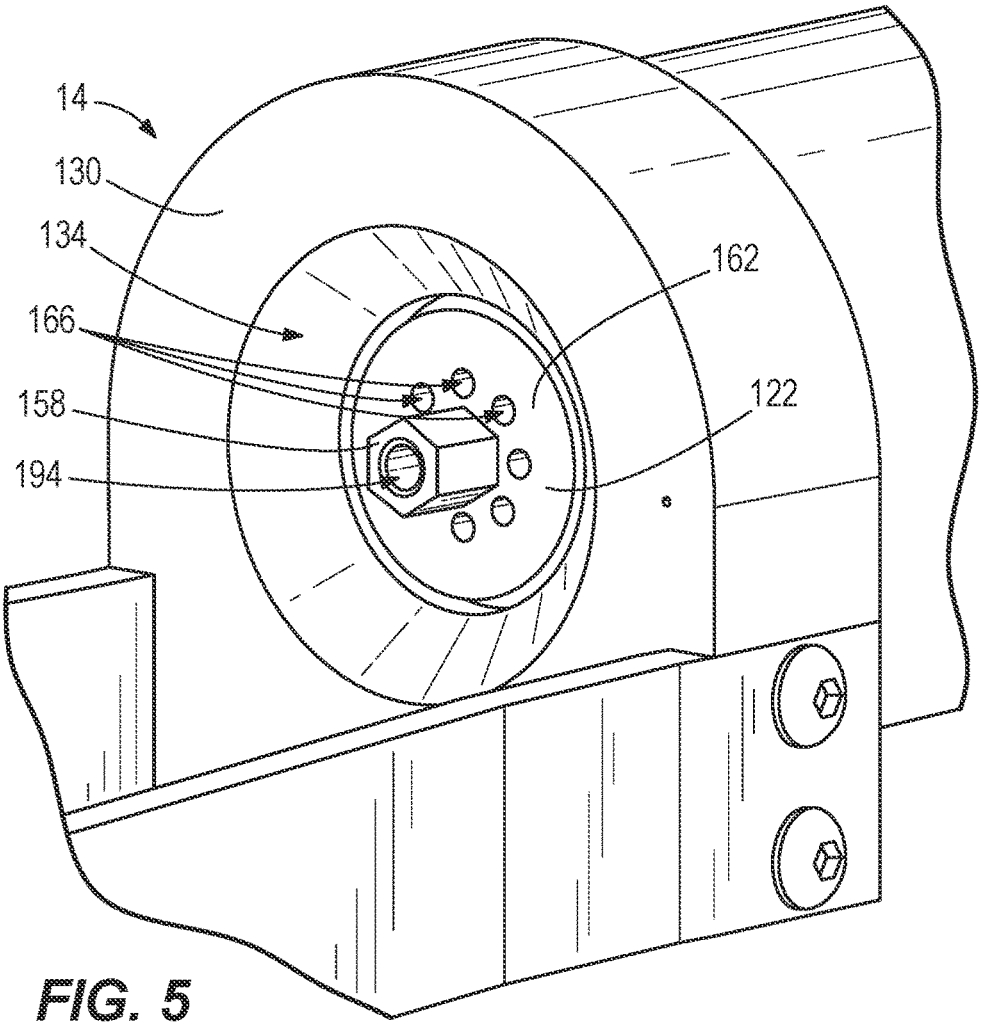
FIG. 5 is a perspective view of the portion of the pump shown in FIG. 3, illustrating the oil filling assembly with an oil fill cap removed.
Figure 6:
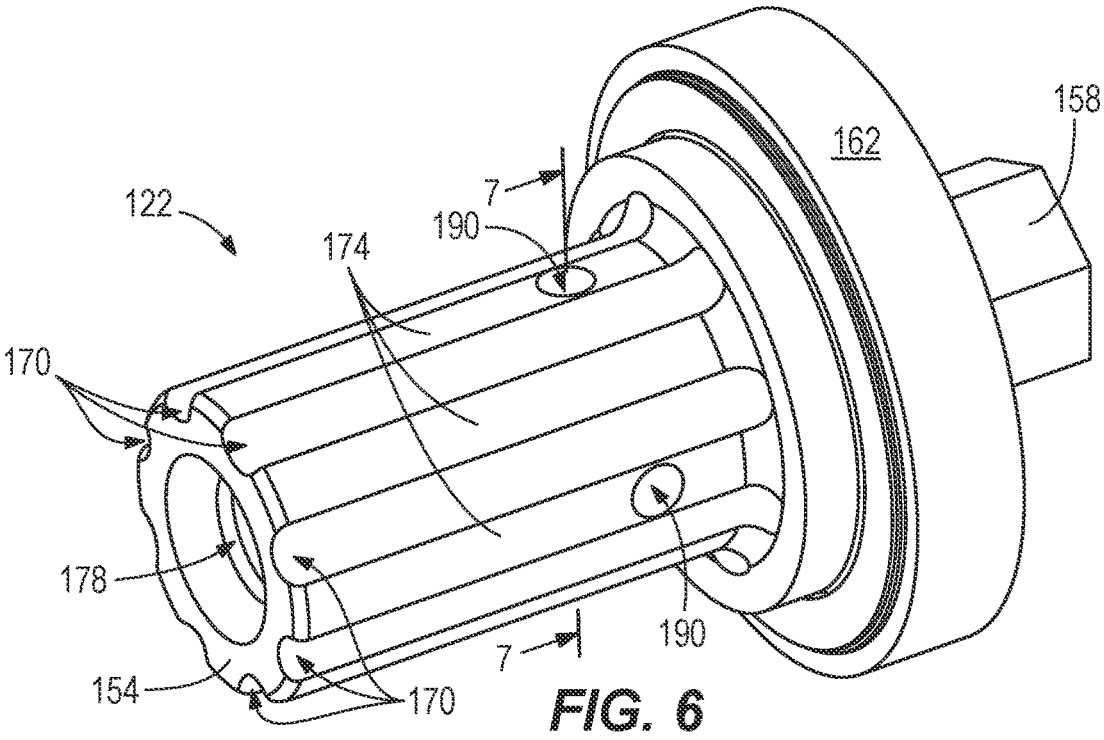
FIG. 6 is a perspective view of an oil fill plug.
Figure 7:
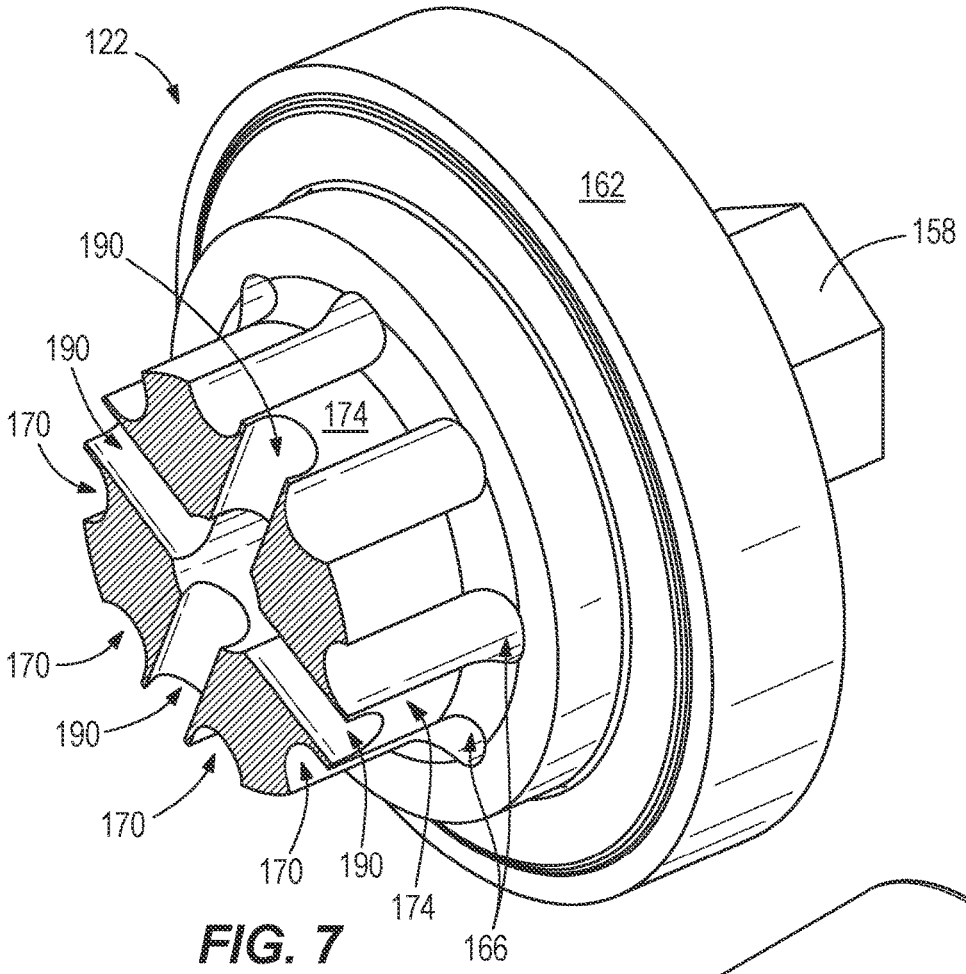
FIG. 7 is a perspective cross-sectional view an inner portion of the oil fill plug.
Figure 8:
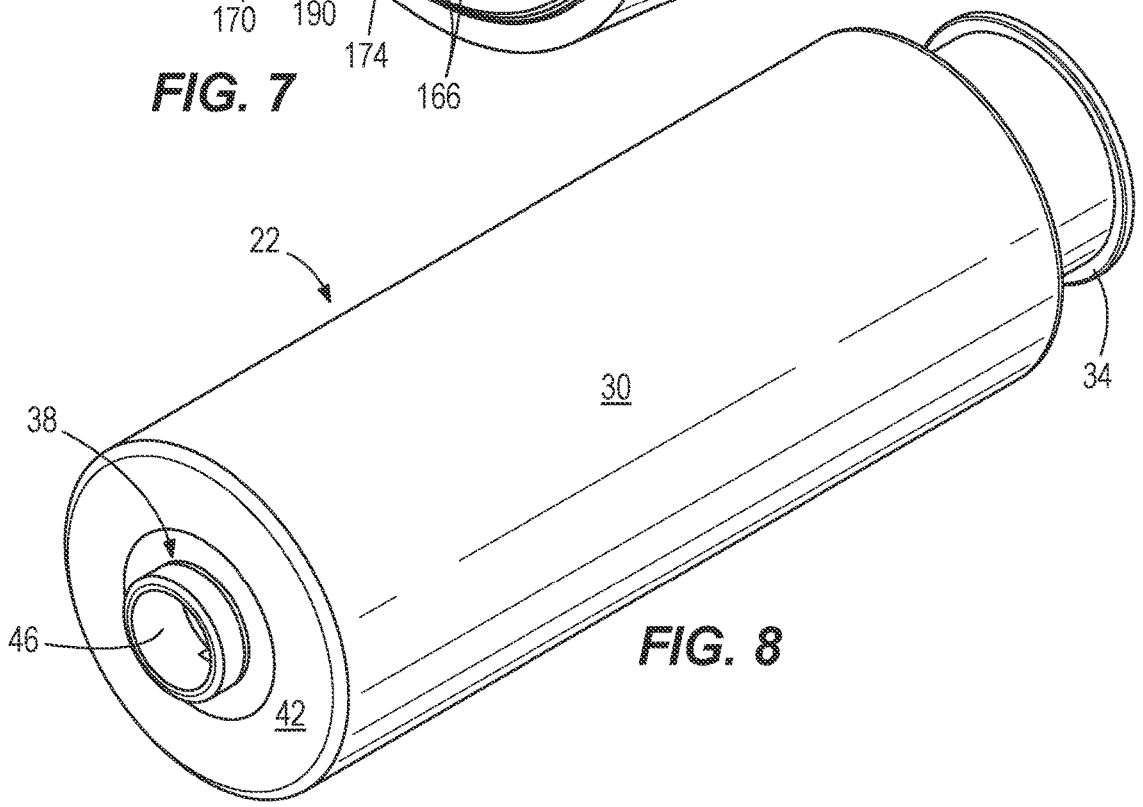
FIG. 8 is a perspective view of a flexible bladder and a bladder fitting shown in FIG. 2.

As shown in FIGS. 2-4, the oil filling assembly 14 includes an end cap 118, an oil filling plug 122, and a cap assembly 126. In the illustrated construction, the handle 70 is connected to the end cap 118. The end cap 118 has an outer end surface 130 and a funnel 134 extending inwardly from the outer end surface 130 to an intermediate step 138. In the illustrated construction, the funnel 134 is defined by a tapering surface between the outer end surface 130 and the intermediate step 138.

A central opening 142 extends from the step 138 to an inner surface of the end cap 118 and has an internally-threaded portion 146. The end wall 42 of the bladder 22 is captured between the inner surface of the end cap 118 and the flange 50 of the fitting 46. The threaded stem 54 of the fitting 46 threads into the threaded portion 146 of the end cap 118 to connect these components and compress the inlet end wall of the bladder 22 therebetween. The inner end surface of the end cap 118 defines an annular groove 150 receiving the end of the cylinder 18.

The plug 122 is constructed to allow oil to flow into the bladder 22 while simultaneously allowing air to flow out of the bladder 22. The plug 122 has an inner stem 154, an outer stem 158 and an intermediate flange 162. The inner stem 154 is inserted into the central opening 142 of the end cap 118, through the opening 58 of the bladder fitting 46 and into the bladder 22. The flange 162 is received in the intermediate step 138 with an annular space therebetween. In this position, the outer end of the outer stem 158 extends axially beyond the outer end surface 130 of the end cap 118 externally to the funnel 134.

A number of oil passages 166 (8 in the illustrated construction) extend through the flange 162. The oil passages 166 are spaced circumferentially about the outer stem 158 and, when the plug 122 is positioned in the end cap 118, are positioned at the inner end of the funnel 134. Each oil passage 166 communicates with a corresponding flow groove 170 defined between adjacent ridges 174 on the outer surface of the inner stem 154 which guide the flow of oil into the bladder 22.

A passage 178 extends through the plug 122 from the outer end of the outer stem 158 and, as illustrated, through the inner stem 154. The passage 178 is threaded along end portions 182, 186 of the stems 154, 158, respectively. A number of air inlets 190 (4 in the illustrated construction) extend radially through the inner stem 154 and communicate with the passage 178. Each air inlet 190 is defined in a ridge 174 between adjacent flow grooves 170 on the outer surface of the inner stem 154. As shown in FIG. 4, the outer surface of each ridge 174 is spaced from the adjacent inner surface of the bladder fitting opening 58, and the air inlets 190 are positioned within the bladder fitting opening 58. The outer end of the passage 178 provides an air outlet 194 positioned, in the illustrated construction, outside of the funnel 134.

A seal gasket 198 (e.g., a copper gasket) is axially between and an o-ring 202 is radially between the flange 162 and the intermediate step 138. A tie rod 206 is threaded, at one end, into the threaded opening 78 of the pump housing 62 and, at the opposite end, into the threaded portion 182 of the inner stem 154 to connect the oil filling assembly 14 to the components of the pump 10 and to compress the sealing components therebetween. The illustrated outer stem 158 is constructed (e.g., has a non-circular shape (for example, a hexagonal shape, as shown)) to be engaged by a tool (e.g., a wrench, a driver, etc.) to turn the plug 122 and threadedly engage the tie rod 206.

In other constructions (not shown), threadedly connected components of the pump 10 (e.g., the bladder fitting 46 and the end cap 118, the tie rod 206 and the pump housing 62 and/or the plug 122, etc.) may be connected in a different manner, such as, for example, via a twist lock, a press fit, welding, etc.

The cap assembly 126 selectively closes the oil passages 166 and the air passage 178. The illustrated cap assembly 126 includes a cap member 210, a washer 214 and a fastener 218. The cap member 210 has an axial wall 222 defining an opening 226, a hollow projection 230 extending from the outer side of the wall 222 and defining a fastener opening 234, and an annular side wall 238 extending inwardly from the radially-outer end of the wall 222.

As shown in FIGS. 2 and 3A, when the cap member 210 is installed onto the plug 122, the outer stem 158 is received into the projection 230, and the wall 222 covers the oil passages 166. The side wall 238 fits in the annular space between the plug flange 162 and the intermediate step 138 of the end cap 118 and engages the o-ring 202. The washer 214 engages the outer end of the projection 230, and the fastener 218 extends through the opening 234 and into the threaded outer portion 186 of the passage 178 to connect the cap assembly 126 to the plug 122. In other constructions (not shown), the cap member 210 may include a fastener incorporated into its structure.

To fill the pump 10, the pump 10 is oriented generally vertically with the oil filling assembly 14 facing upwardly. The fastener 218 is removed so the cap member 210 can be removed to open the oil passages 166 and the air passage 178. Oil is poured to fill the funnel 134 which guides the oil toward the oil passages 166. Oil flows the passages 166 and along the flow grooves 170 into the bladder 22. Simultaneously, air enters the air inlets 190, spaced (e.g., circumferentially and radially) from the inwardly flowing oil, into the passage 178 and through the air outlet 194. As mentioned above, the outer end of the outer stem 158 extends outside of the funnel 134 so that air can flow from and oil will not enter the air outlet 194.

When the bladder 22 is filled, the cap assembly 126 is reinstalled. The cap member 210 is positioned with the outer stem 158 in the projection 230, the wall 222 engaging the flange 162 and closing the oil passages 166, and the side wall 238 in the annular space and engaging the o-ring 202. The washer 214 is positioned, and the fastener 218 is threaded into the threaded portion 186 of the air passage 178, closing the air passage 178. The pump 10 is ready for use, and, with the flexible bladder 22, is usable in substantially any orientation.

To use the pump 10, the operator fluidly connects (e.g., with a hose (not shown)) the pump 10 and the external device (e.g., the hydraulic cylinder) with which the pump 10 will be used. The operator engages and moves the actuator handle 110 to cause oil to flow between the bladder 22 and the external device.

It should be understood that one or more features of one construction of a pump 10, described above or illustrated in the drawings may be incorporated into another construction and vice versa.

One or more independent features and/or independent advantages of the invention may be set forth in the claims.

What is claimed is:

1. A pump comprising:

a flexible bladder configured to contain oil, the bladder having a bladder inlet and a bladder outlet;

a pump mechanism in fluid communication with the bladder outlet and configured to dispense oil from a pump port; and a plug including a body extending along an axis and having a flange, a first stem extending from one side of the flange, and a second stem extending from an opposite side of the flange, the first stem being configured to extend into the bladder inlet, the body defining an oil passage and a separate air passage configured to allow simultaneous flow of oil into the bladder and air out of the bladder.

2. The pump of claim 1, wherein the second stem defines an air outlet communicating with the air passage, at least a portion of the air passage extending along the axis through a portion of the body.

3. The pump of claim 2, wherein the body defines a plurality of oil passages circumferentially spaced about the axial portion of the air passage.

4. The pump of claim 2, wherein the first stem defines an air inlet in communication with the air passage, another portion of the air passage extending radially between the air inlet and the axial portion of the air passage.

5. The pump of claim 4, wherein the body defines a plurality of air inlets communicating with the air passage, a corresponding portion of the air passage extending radially between each of the plurality of air inlets and the axial portion of the air passage.

6. The pump of claim 5, wherein the first stem defines axially-extending ridges and grooves, each of the plurality of air inlets being defined through a corresponding ridge.

7. The pump of claim 6, wherein the body defines a plurality of oil passages circumferentially spaced about the axial portion of the air passage, the plurality of oil passages extending through the flange, each of the plurality of oil passages communicating into a corresponding groove.

8. The pump of claim 7, further comprising a fitting received in the bladder inlet, the fitting defining a fitting opening having an inner surface, the first stem extending through the fitting opening, each groove having a groove surface spaced from the inner surface.

9. The pump of claim 8, wherein the fitting has a projection with a threaded outer surface, and wherein the pump further comprises an end cap defining a cap opening with a threaded inner surface threadedly engageable with the outer surface of the projection.

10. The pump of claim 9, wherein the bladder has an inlet wall defining the bladder inlet, a portion of the inlet wall being between the fitting and the end cap.

11. The pump of claim 1, further comprising a funnel having a funnel wall surrounding the plug, the funnel being constructed to cause oil to flow toward the oil passage.

12. The pump of claim 11, wherein the funnel has a funnel end surface, and wherein the second stem has a stem end surface defining an air outlet communicating with the air passage, the stem end surface being axially beyond the funnel end surface and outside of the funnel wall.

13. The pump of claim 1, further comprising a tie rod extending along the axis and having a first end threadedly engaging the pump mechanism and a second end threadedly engaging the plug.

14. The pump of claim 13, wherein the body defines a central opening, the central opening providing a portion of the air passage, the first stem defining an inner opening end threadedly engaging the second end of the tie rod.

15. The pump of claim 14, wherein the second stem defines an outer opening end providing an air outlet communicating with the air passage.

16. The pump of claim 1, further comprising a cap assembly selectively engageable with the plug to close the oil passage and the air passage.

17. The pump of claim 16, wherein the opposite side of the flange defines an oil inlet communicating with the oil passage, and wherein the cap assembly includes a cap member having a cap wall selectively engaging the flange to close the oil inlet.

18. The pump of claim 16, wherein the second stem has a stem end surface defining an air outlet communicating with the air passage, wherein the cap assembly includes a cap member defining a cap projection receiving the second stem, and a fastener engageable through the cap projection into the air outlet to close the air passage.

19. The pump of claim 1, wherein the pump mechanism includes a manual actuator engageable by an operator to cause the pump mechanism to dispense oil.

20. The pump of claim 1, further comprising a cylinder supporting the bladder.

21. The pump of claim 20, wherein the cylinder has a cylinder wall with a first end engaging the pump mechanism and an opposite second end, the bladder outlet being positioned proximate the first end, the bladder inlet being positioned proximate the second end.

22. The pump of claim 21, further comprising an end cap engaging the second end, the end cap providing a funnel having a funnel wall surrounding the plug, the funnel being constructed to cause oil to flow toward the oil passage.

23. The pump of claim 22, wherein the end cap has a cap end surface, and wherein the second stem has a stem end surface defining an air outlet communicating with the air passage, the stem end surface being axially beyond the cap end surface and outside of the funnel wall.

24. A pump comprising:

a cylinder having a cylinder wall with a first cylinder end and an opposite second cylinder end;

a flexible bladder supported by the cylinder and configured to contain oil, the bladder having a bladder outlet positioned proximate the first cylinder end and a bladder inlet positioned proximate the second cylinder end;

a pump mechanism engaging the first cylinder end, the pump mechanism being in fluid communication with the bladder outlet, the pump mechanism including a manual actuator engageable by an operator to cause the pump mechanism to dispense oil from a pump port; and an oil filling assembly positioned proximate the second cylinder end, the assembly including a plug including a body defining an oil passage and a separate air passage configured to allow simultaneous flow of oil into the bladder and air out of the bladder, the body extending along an axis and having a flange, a first stem extending from one side of the flange, and a second stem extending from an opposite side of the flange, the first stem being configured to extend into the bladder inlet, the second stem having a stem end surface defining an air outlet communicating with the air passage, and an end cap engaging the second cylinder end, the end cap providing a funnel having a funnel wall surrounding the plug, the funnel being constructed to cause oil to flow toward the oil passage, the end cap having a cap end surface, the stem end surface being axially beyond the cap end surface and outside of the funnel wall.

* * * * *